US007914005B2

(12) United States Patent
Blessing et al.

(10) Patent No.: US 7,914,005 B2
(45) **Date of Patent: *Mar. 29, 2011**

(54) HAND-HELD SETTING TOOL WITH CONNECTION MEANS FOR A POSITIONING DEVICE

(75) Inventors: Matthias Blessing, Frastanz (AT); Walter Schaepper, Buchs (CH); Markus Sprenger, Mauren (LI)

(73) Assignee: Hilti Aktiengesellchaft, Schaan (LI)

( * ) Notice: Subject to any disclaimer, the term of this patent is extended or adjusted under 35 U.S.C. 154(b) by 267 days.

This patent is subject to a terminal disclaimer.

(21) Appl. No.: 12/156,167

(22) Filed: May 30, 2008

(65) Prior Publication Data

US 2008/0302849 A1 Dec. 11, 2008

(30) Foreign Application Priority Data

Jun. 1, 2007 (DE) ..... 10 2007 000 302

(51) Int. Cl.
*B25C 1/08* (2006.01)

(52) U.S. Cl. ..... 277/8; 227/9; 227/10

(58) Field of Classification Search ..... 227/8–10, 227/156; 173/8–10; 42/70.09
See application file for complete search history.

(56) References Cited

U.S. PATENT DOCUMENTS

| | | | | | |
|---|---|---|---|---|---|
| 443,747 | A * | 12/1890 | Von Derschau | 42/70.09 |
| 908,982 | A * | 1/1909 | Ely | 42/70.09 |
| 953,279 | A * | 3/1910 | Moore | 42/70.01 |
| 960,185 | A * | 5/1910 | Moore | 42/70.09 |
| 2,041,661 | A * | 5/1936 | Lepp | 42/70.05 |
| 2,273,204 | A * | 2/1942 | Kneubuehl | 42/70.09 |
| 3,081,998 | A * | 3/1963 | Weiss | 273/440 |
| 4,479,599 | A * | 10/1984 | Conrad | 227/9 |
| 5,429,291 | A * | 7/1995 | Thompson | 227/10 |
| 5,465,893 | A * | 11/1995 | Thompson | 227/8 |
| 5,518,161 | A * | 5/1996 | Thompson | 227/8 |
| 7,014,085 | B2 * | 3/2006 | McCullough | 227/8 |
| 7,090,107 | B2 * | 8/2006 | Buechel et al. | 227/8 |
| 7,213,359 | B2 * | 5/2007 | Beretta | 42/70.08 |
| 7,228,917 | B2 * | 6/2007 | Davis et al. | 173/170 |
| 7,258,261 | B1 * | 8/2007 | Reyes | 227/110 |
| 7,565,991 | B2 * | 7/2009 | Erhardt | 227/8 |
| 2005/0121487 | A1 * | 6/2005 | Buechel et al. | 227/10 |
| 2006/0277808 | A1 * | 12/2006 | Danner et al. | 42/70.09 |
| 2008/0302849 | A1 * | 12/2008 | Blessing et al. | 227/110 |

* cited by examiner

*Primary Examiner* — Rinaldi I. Rada
*Assistant Examiner* — Lindsay Low
(74) *Attorney, Agent, or Firm* — Abelman, Frayne & Schwab

(57) ABSTRACT

A hand-held setting tool (10) includes a connection element (16) for connecting the setting tool (10) with a positioning device (20) having a switching link (30) for connecting the actuation element (24) to the actuation switch (13) of the setting tool (10), and a safety device (50) for preventing actuation of the actuation switch (13) at an orientation of the setting tool (10) other than a predetermined orientation and including at least three blocking members (55*a*, 55*b*, 55*c*) displaceable in at least three separate channels (56) respectively, and receivable in a recess (51) formed in a first, switching element (34) of the switching link (30) with the channels (56) being inclined with respect to a plane (E) extending perpendicular to a longitudinal axis (A) of the positioning device, and with at least three channels (56) intersecting, in some regions, an axial projection of the switching element (34).

8 Claims, 5 Drawing Sheets

HAND-HELD SETTING TOOL WITH CONNECTION MEANS FOR A POSITIONING DEVICE

BACKGROUND OF THE INVENTION

1. Field of the Invention

The present invention relates to a hand-held setting tool including an actuation switch, connection means for connecting the setting tool to a positioning device and having a counter-coupling element for the positioning device, a structural component, and a mechanical switching link including at least one first switching element displaceable in the structural component along an axis of the setting tool for connecting an actuation element provided on the positioning device with the actuation switch, and a safety device for preventing actuation of the actuation switch of the setting tool at an orientation of the setting tool other than a predetermined orientation.

2. Description of the Prior Art

Positioning tools of the type described above are used, e.g., at overhead works in case of high ceilings when working is possible only using working platforms or ladders. Setting tools, which can be used with such devices, can be driven with solid, gaseous, or liquid fuels or with compressed air or electricity.

U.S. Pat. No. 4,479,599 discloses a positioning and actuation device for a combustion-operated setting tool and including connection means for the setting tool, which is arranged at an end of an elongated holder and is formed as a rod or a bar. The rod or bar is axially displaceable relative to the connection means for actuating the actuation switch of the setting tool that is secured at the connection means via coupling means. For actuating the setting tool, the tool should be placed with its muzzle part against a ceiling and then be displaced in the direction of the ceiling with the holder or rod by the user.

Further, the positioning and actuation device has a safety device which prevents the setting tool from being actuated when the muzzle part is oriented exactly in the direction of the force of gravity. For this purpose, the safety device has a blocking member formed as a ball which is guided in a recess formed as a channel and extending in the connection means diagonally to the longitudinal axis of the rod. At an orientation of the tool in the direction of the gravitational force, the ball rolls into the movement path of the rod and prevents a further movement of the rod relative to the connection means and, therefore, prevents actuation of the setting tool secured on the connection means. To this end, the rod has, at its end adjacent to the connection means, a radially circumferential recess into which the ball can fall.

The drawback here consists in that the actuation of the setting tool can only be safely prevented when the positioning and actuation device with the setting tool is oriented exactly with the muzzle part facing in the direction of the force of gravity.

U.S. Pat. No. 7,014,085 discloses an explosion-actuated setting tool having a housing, an elongated holder projecting therefrom, and a ball-controlled safety locking device which permits the setting tool to be actuated only in a vertical or almost vertical orientation opposite to the force of gravity. The ball of the ball-controlled device is arranged in an annular receiving space between the holder and the housing.

However, the drawback of the setting tool of U.S. Pat. No. 7,014,085 consists in that the diameter of the ball defines the maximum movement path of the holder relative to the housing which is available in the release position of the ball and within which all of the necessary functions such as, e.g., initiating of ignition, must be carried out. Therefore, a very high pressing force is needed for this short movement path.

Another disadvantage consists in that widely different angles result when the setting tool is lifted upward until released, and when the setting tool is lowered until blocked again; that is, the limiting angle at which a setting process is still possible when the setting tool deviates from a vertical orientation opposite to gravitational force can vary dependent on the changes in orientation of the setting tool prior to actuation. Moreover, when the setting tool is pressed horizontally against a wall or downwardly against a floor by moving the tool up or down, the blocking ball rolls out of its blocking position, and the setting tool becomes inadvertently released.

SUMMARY OF THE INVENTION

An object of the present invention is a setting tool having connection means for a positioning device and actuation means of the type discussed above and in which the above-discussed drawbacks of the known setting tools are eliminated.

Another object of the present invention is a setting tool of the type discussed above in which the safety device provides for actuation of a setting process with remote actuation means in a predetermined angular region of orientation of the setting tool with respect to the vector of the gravitational force, and enables an adequate switching stroke for actuation of the setting tool at a small expenditure of force.

This and other objects of the present invention, which will become apparent hereinafter, are achieved according to the invention, by providing a setting tool the safety device of which includes at least three separate channels and at least three blocking members displaceable in the at least three separate channels, respectively, with the first switching element having a recess for receiving the blocking members and which opens toward the structural component, with the at least three channels being inclined with respect to a plane extending perpendicular to the longitudinal axis and with the at least three channel intersecting, in some regions, an axial projection of the switching element in the form of a secant and opening toward the switching element in respective overlapping regions. The intersection of the axial projection of the switching member by the channels in the form of a secant means that the channels do not extend toward the axis of the switching element but rather intersect the axial projection of the switching element along its periphery.

The novel features of the present invention insure, on one hand, that a locking position of the safety device is reached not only at a certain orientation of the setting tool but also rotationally symmetrically with respect to the longitudinal axis in other tilting positions that deviate from the predetermined orientation. This is because at least one blocking member always lies in the overlapping region of a respective channel and extends thus, into the recess of the switching element. Thus, e.g., the blocking position is always then actuated when the setting tool is moved in a tilting position to a vertical (i.e., with respect to the orientation in a direction opposite to the vector of the gravitational force) that exceeds the maximum allowable tilting angle.

On the other hand, the maximum stroke of the switching member is not determined by the size of the blocking members. Therefore, the function, which is controlled by the press-on path such as, e.g., actuation of the setting tool or displacement of a cartridge in case of a powder charge-operated setting tool, can be determined based on an optimal force-path ratio. Thereby, a need in high pressure forces can be eliminated. It can also be desirable to be able to actuate the setting tool when the positioning device is oriented in the direction of the vector of the gravitational force and/or in a tilting, with respect to this orientation, position.

Advantageously, the at least three channels are distributed about the longitudinal axis rotationally symmetrically. Thus, the blocking function provides for actuation of the safety device about its longitudinal axis at the same release angle in each rotational position.

Advantageously, the blocking members are formed as pin-shaped members. Thereby, a premature release of the blocking position can be prevented when the device is dynamically displaced against a wall or a floor, and the blocking members have a tendency, because of the occurring acceleration forces, to move out of their blocking position. This is because the pin-shaped blocking members contrary to the ball-shaped blocking members block the release over their entire axial length, thus, preventing the premature release of the blocking position.

From the manufacturing point of view, it is advantageous when the switching element is rod-shaped and is displaced in a guide channel of the structural component.

It is advantageous, when the at least three channels are inclined to the plane which extends perpendicular to the longitudinal axis, each at an angle between 20° and 50°. This permits, on one hand, a reliable free switching at an orientation transverse to a direction opposite the direction of the vector of the gravitational force or at an orientation slightly inclined to this transverse orientation and, on the other hand, reliably blocks the actuation at an orientation perpendicular to the vector of the gravitational force (horizontal) orientation, or at a dynamic pressure in the direction of the gravitational force.

Advantageously, the overlapping region of a channel with respect to the axial projection of the switching element has a depth toward the longitudinal axis, smaller than a diameter of the channel. Thereby, a reliable guidance of the blocking members in the channels is achieved though the intersection of the channels with the axial projection of the switching element or the guide bore for the switching element defines a secant.

It is further advantageous when the recess in the switching element is formed as an annular groove closed in both axial directions of the switching element. This insures a good access of the recess for the blocking members and their easy displacement from the channels into the recess for effecting blocking when the setting tool is displaced in a position in which an actuation is not desired.

It is further advantageous when the recess in the switching element has walls that limit the recess in an axial direction and that are inclined to the longitudinal axis so that an axial width of the recess diminishes from a radially outer side to a radially inner side. Thereby, the pin-shaped blocking members have, in the blocking position, not a point but linear contact with the inclined walls of the recess. Thereby, the surface pressure in the contact region can be reduced.

The novel features of the present invention which are considered as characteristic for the invention, are set forth in the appended claims. The invention itself, however, both as to its construction and its mode of operation, together with additional advantages and objects thereof, will be best understood from the following detailed description of the preferred embodiment, when read with reference to the accompanying drawings.

DETAILED DESCRIPTION OF THE PREFERRED EMBODIMENT

FIGS. 1 through 5 show a hand-held setting tool 10 according to the present invention and a positioning device 20 with actuating switching means for the setting tool 10 and which can be formed as a modular unit. Such positioning devices 20 are used for elongation of setting tools in order, e.g., to be able to perform an overhead work on ceilings, etc. with the setting tool.

Figure 1:
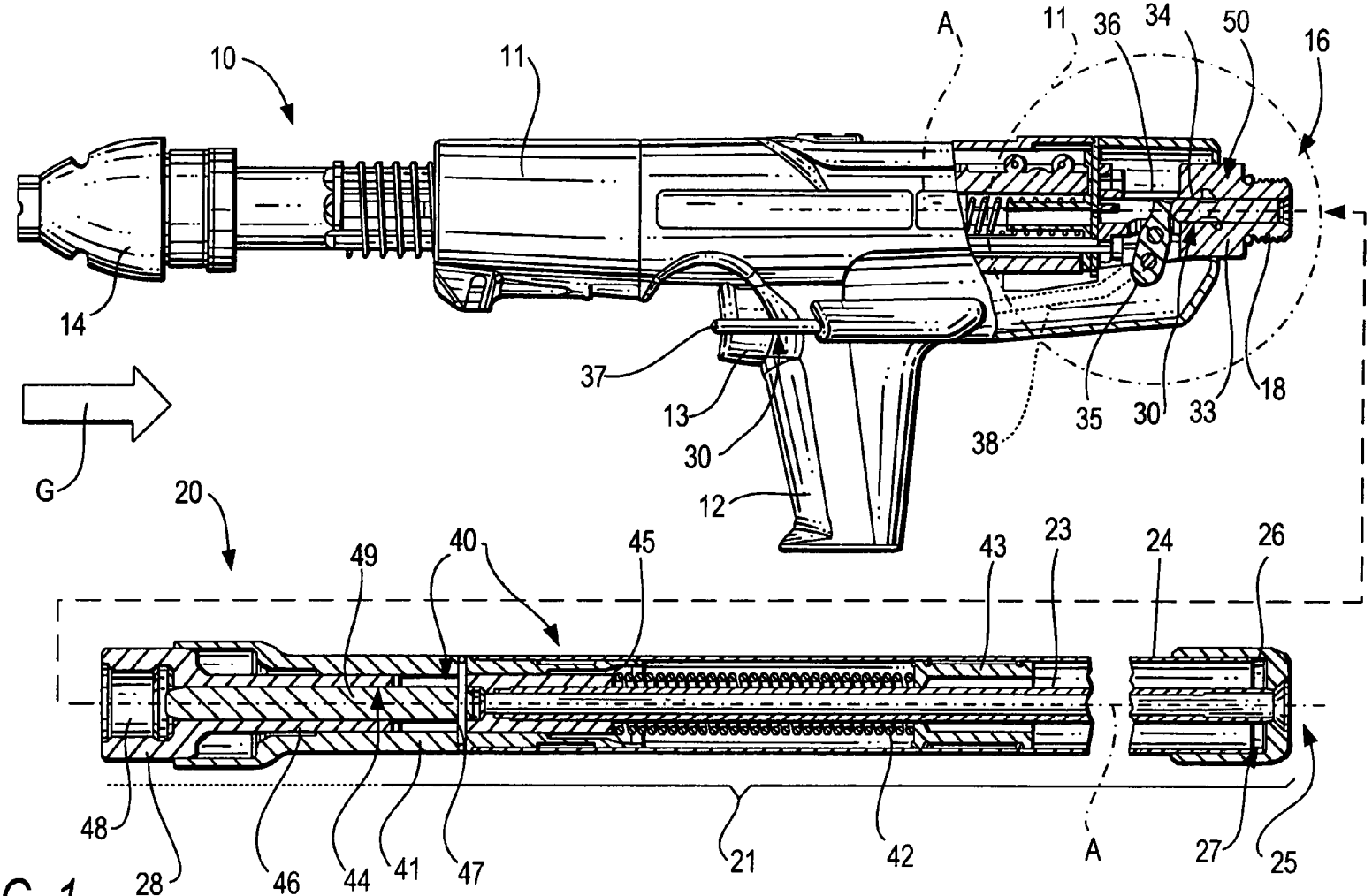
FIG. 1 a partially exploded, partially cross-sectional view of a hand-held setting tool with a positioning device according to the invention in a non-pressed position.

The positioning device 20, which is shown in FIG. 1, has a rod-shaped holder 21 provided with a coupling element 28 that cooperates with a counter-coupling element 18 forming part of connection means 16 of the setting tool 10, for connecting the rod-shaped holder 21 with the setting tool 10. The coupling element 28 and the counter-coupling element 18 form a releasable connection, so that the positioning device 20 and the setting tool 10 can be assembled together and disassembled. The connection of the coupling element 28 and the counter-coupling element 18 can be formed, e.g., as a threaded or bayonet connection.

In addition to the holder 21 shown in FIG. 1, one or more elongation parts can be provided which are inserted between the holder 21 and the setting tool 10 and which are provided at one end with a coupling element and at an opposite end with a counter-coupling element.

A longitudinal extension of the setting tool 10 and a longitudinal extension of the holder 21 define an axis A of the assembly.

The setting tool 10 shown in FIG. 1 has a setting mechanism arranged in a housing 11, which can be formed of one or more parts, for driving fastening elements into a constructional component. An actuation switch 13 is arranged on a handle 12 of the setting tool 10 for actuating a setting process. A muzzle part, designated in its entirety by a reference numeral 14, is arranged on the setting tool 10 in front of the housing 11 and can be displaced relative to the housing 11. When the muzzle part 14 of the setting tool 10 is pressed against a construction component (not shown in the drawings), the condition of the setting tool 10 changes to a setting-ready state in which a setting process can be actuated by the actuation switch 13. The setting tool 10 has further a switching link 30 that is operatively connectable, at the connection means 16, with remote actuation means 40 of the positioning device 20.

The remote actuation means 40 of the positioning device 20 and the switching link 30 serve for connecting an actuation element 24 provided on the holder 21 with the actuation switch 13 of the setting tool 10. Thus, the actuation element 24 acts as a remote actuation element.

The actuation element 24, which is formed as an elongate sleeve, is guided over a supporting element 23 of a support structure and formed as a hollow bar. As an alternative to an actuating sleeve, an actuating lever could also be used and, e.g., arranged at a grip part at an end of the holder 21 remote from the coupling element 28.

The actuation element 24 is displaceable parallel to the longitudinal axis A relative to the supporting element 23. A base part 26, which projects beyond an axial end 27 of the actuation element 24 remote from the connection means 16, is arranged at a free end 25 of the supporting element 23 or the holder 21 remote from the coupling element 28. The supporting element 23 is fixedly connected to a coupling element 28 which has a receptacle 48 for a counter-coupling element 18 at its end remote from the supporting element 23. A support point 45 for a spring element 42 is formed at an end of the coupling element 28 adjacent to the base part 26. The spring element 42 is supported with its other end against the actuation element 24 by an intermediate element 43 formed as an inner sleeve, and elastically loads the latter in the direction of its initial position which is shown in FIG. 1. The intermediate element 43 is fixedly connected to the actuation element 24.

The actuation element 24 is connected to a sleeve-shaped, first switching member 41 of the remote actuation means 40 and which at least partially surrounds a portion 46 of the coupling element 28 that is secured to the supporting element 23. The first switching member 41 cooperates with a second switching member 49 which is displaceably guided in a guide 44 in the coupling element 28 that is formed as a blind hole. The first switching member 41 is in turn connected to the second switching member 49 by a connection element 47 which extends perpendicular to the longitudinal axis A and is formed as a stud. The connection element 47 extends through a slit-shaped opening (not shown) in the portion 46 of the coupling element 28 which makes it possible for the connection means 47 to be displaced relative to the coupling element 28 and parallel to the longitudinal axis A.

Upon connection of the positioning device 20 with the setting tool 10, the second switching member 49 of the remote actuation means 40 cooperates with pin-shaped first switching element 34 of the switching link 30 of the setting tool 10, whereby a switching displacement of the remote actuation means 40 at least in one direction along the axis A is transmitted to the switching link 30.

The switching link 30 of the setting tool 10 has, in addition to the first switching element 34 displaceable along the axis A, a second switching element 35 which is formed as a pivot lever. A cam 36, which cooperates with a first switching element 34, is provided on the first lever arm, and a third switching element 38 of the switching link 30 is connected to the second lever arm of the pivot lever. The third switching element 38 is formed as a control bar and is connected with a driver 37 of the switching link 30 and which cooperates with the actuation switch 13 of the setting tool 10. A spring (not shown in the drawings) biases the switching link 30, together with the driver 37, into its non-actuated position shown in FIG. 1 and in which the driver 37 does not apply pressure to the actuation element 13.

The setting tool 10 further includes a safety device designated in its entirety by a reference numeral 50 (see in particular FIG. 2-5) which prevents the setting tool 10 arranged at the positioning device 20 from being actuated via switching link 30 or being remotely actuated by the actuation element 24 of the positioning device 20 in any orientation other than a permitted orientation. The safety device 50 is located between a structural component 33 of a guide structure for the switching link 30, which in the embodiment shown in the drawings, forms a guide for the first switching element 34 at the connection means 16, and a switching element of the switching link 30 displaceable relatively the structural component 33 axially along the axis A, which switching element is formed by the first switching element 34 in the embodiment shown in the drawings. The safety device 50 has a recess 51 that is formed as a radial annular groove on the outer surface of the first switching element 34. The recess 51 opens radially outer or toward the structural component 33. In the axial direction, the recess 51 is limited by groove walls 52 extending at an angle toward the axis A so that the axial width of the recess 51 diminishes from its radially outer side toward its radially inner side.

Figure 2:
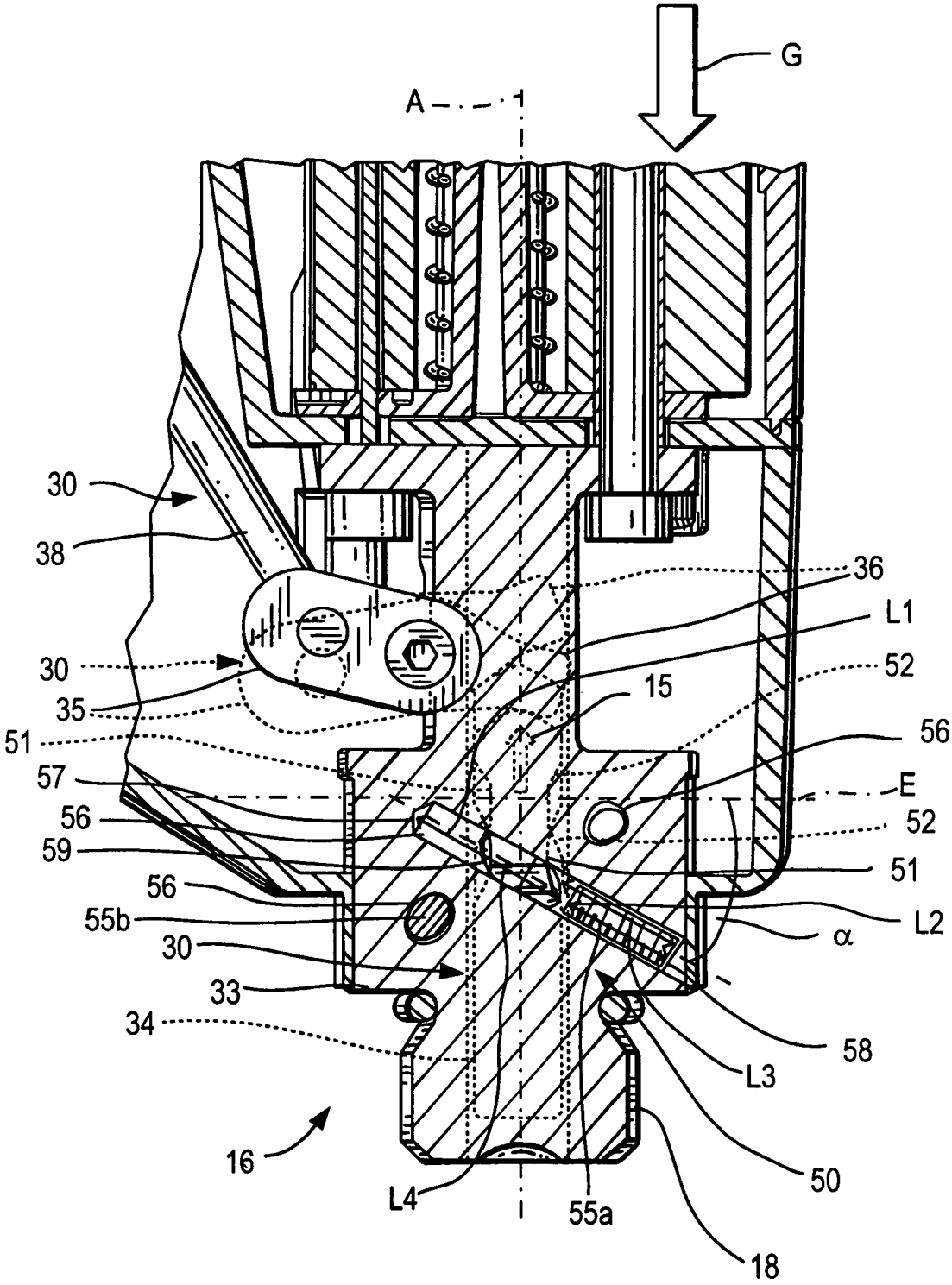
FIG. 2 a cross-sectional longitudinal, parallel to the longitudinal axis, view at an increased, in comparison with FIG. 1, scale, of a portion II of the detail of the setting tool according to the invention with the muzzle part of the setting tool facing in a direction opposite the direction of the gravitational force in a non-actuated position and with indication of an actuated position.
Figure 3:
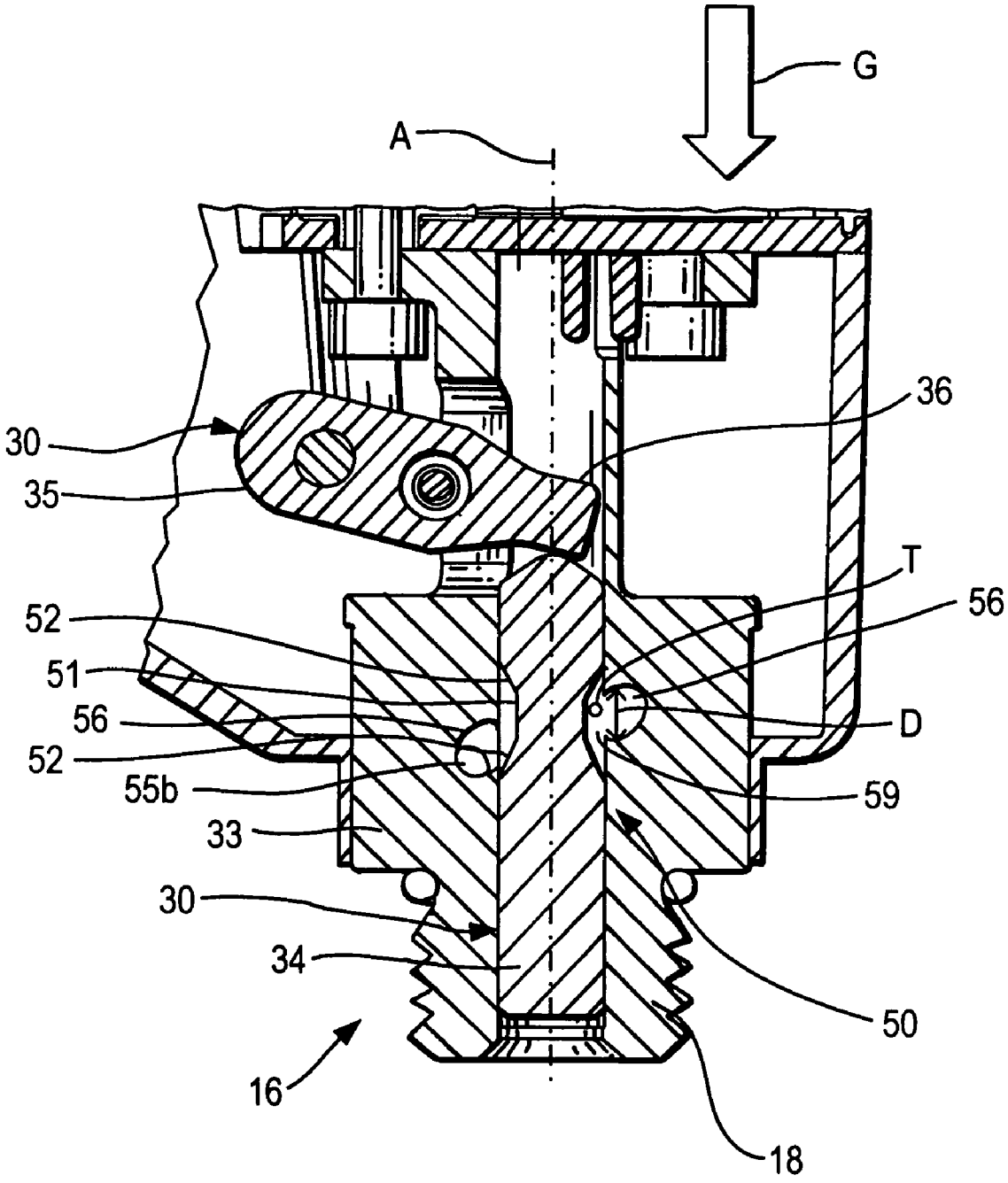
FIG. 3 a cross-sectional longitudinal view of the detail of the setting tool shown in FIG. 2 in the non-actuated position.
Figure 4:
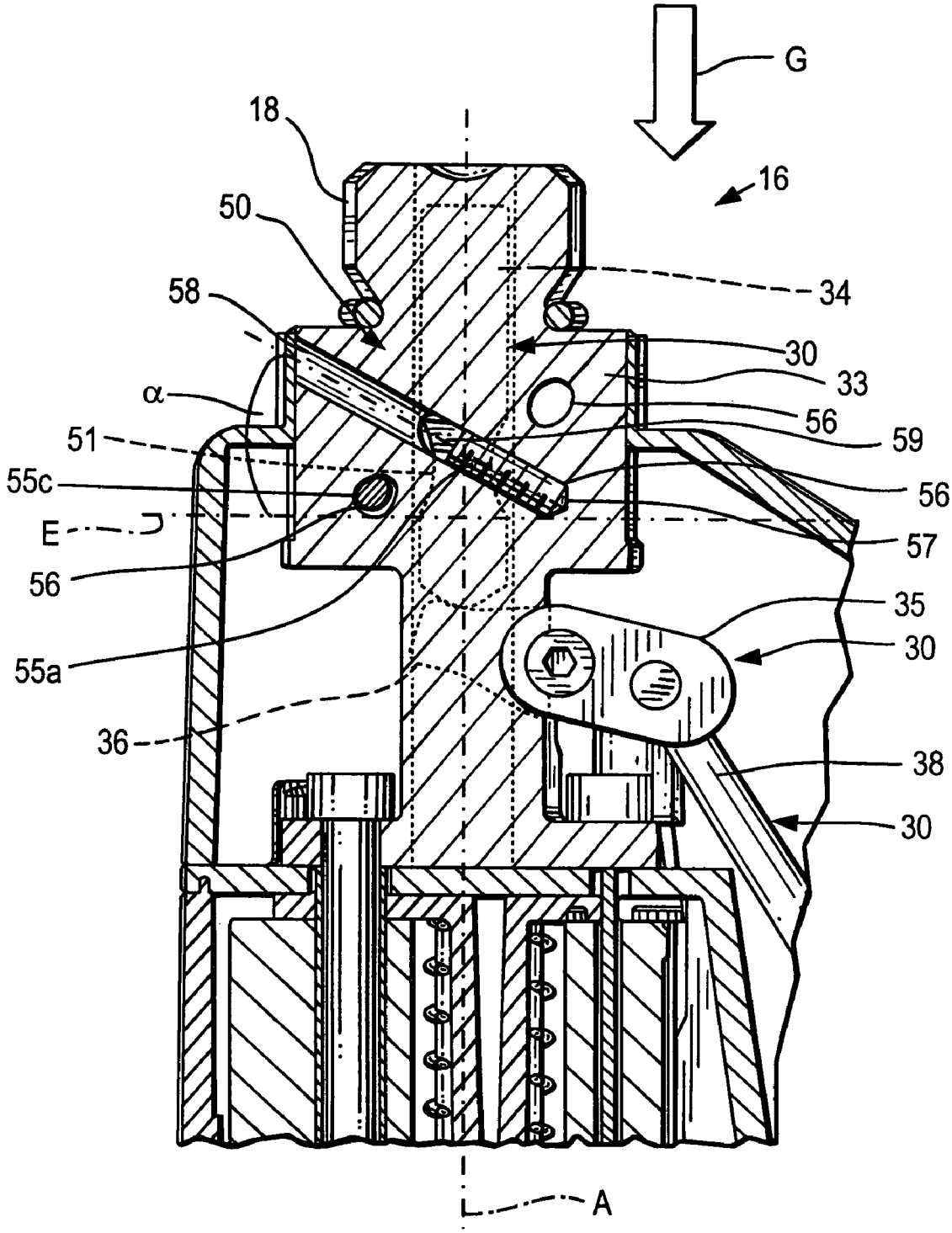
FIG. 4 a cross-sectional longitudinal, parallel to the longitudinal axis, view of a detail of the setting tool shown in FIG. 2 with a vertical orientation of the muzzle part of the setting tool in a direction of action of the gravitational force in a non-actuated position.

The safety device 50 further has a plurality of channels 56, exactly three in the shown embodiment, which are provided in the structural component 33 and are distributed rotationally symmetrically about the axis A (see in particular FIG. 5), and are inclined at angle $\alpha$ from 20° to 50° to a plane E extending perpendicular to the axis A (see in particular FIGS. 2 and 4). The channels 56 have, perpendicular to their longitudinal extent, a circular cross-section. A radially outer end 58 of the channels 56 is open at an outer surface of the structural component 33, and the radial inner end 57 of the channels 56 is closed. The openings of the channels 56 are closed at their radially outer ends by the housing 11 (see FIGS. 2 and 4). The channels 56 intersect in the form of a secant, in some regions, an axial projection (or the guide channel) of the first switching element 34 and are open toward the first switching member 34 in these overlapping regions 59. A length L2 of the channels 56 from its radially outer end 58 toward the overlapping region 59 is greater than a length L1 of the channel 56 from its inner end 57 toward the overlapping region 59 (see FIG. 2). The overlapping regions 59 of the channels 56 and the axial projection of the first switching member 34 have, toward the axis A, a depth T that is smaller than a diameter D of the channels 56 (see in particular FIG. 3). A blocking member 55*a*, 55*b*, 55*c*, which is formed as an elongate, cylindrical pin, is displaceably arranged in each channel 56. The length L1 of the channels 56 from the inner end 57 toward the overlapping region 59 is smaller than a length L3 of the pin-shaped blocking member 55*a*, 55*b*, 55*c* (see FIG. 2). Further, a length L4 of the overlapping channel 59 in the longitudinal direction of the channel 56 is smaller than the length L3 of the pin-shaped blocking member 55*a*, 55*b*, 55*c*.

In the initial position of the setting tool 10 and the positioning device 20 shown in FIGS. 1-3, the muzzle part 14 of the setting tool 10 is oriented in a direction opposite the direction of the vector G of the force of gravity (e.g., in a direction of a ceiling). The actuation element 24 and, thereby, the remote actuation means 40 are inactive, and the actuation element 24 is inactive and is displaced into the cup-shaped base part 26 to the maximum distance by the spring element 42. Therefore, the first switching element 34 is moved into the guide channel in the structural component 33 likewise to the maximum distance (FIG. 1). The second switching element 35 and the rest of the switching link 30 with the driver 37, following in the direction of stroke, is inactive.

FIGS. 2 and 3 show an enlarged view of an area of the setting tool 10 with the safety device 50, with the setting tool 10 being oriented with respect to the vector G of the gravitational force, as shown in FIG. 1. As shown, the pin-shaped blocking member 55*a* is located in the channel 56, extending radially outer in a region adjacent to the radially outer end 58 and, thus, without blocking the overlapping region 59 between the structural component and the first switching element 34. The other blocking members 55*b*, 55*c* (in FIG. 2, the blocking member 55*c* is located outside of the cross-sectional plane and is, therefore, not visible) are also located radially outer in the respective channels 56 in regions adjacent to respective outer ends 58, likewise not blocking the respective overlapping regions 59. The safety device 50 is located at this orientation of the setting tool 10 and positioning device 20 in its actuation-permitting position. The setting tool 10, which is attached to the positioning device 20, can be pressed, at this orientation, with its muzzle part 14 against a ceiling or another constructional component and can be actuated by displacement of the actuation element 24 in a direction of the coupling element 28 because the blocking members 55*a*, 55*b*, 55*c* permit a relative movement of the first switching member 34 with respect to the structural component 33 due to their inserted position in the first recess 51. As shown in FIG. 2, the first switching member 34 is displaced axially by the second switching member 49 (shown only in FIG. 1) in direction of a first arrow 15 or in direction of the muzzle part 14 relative to the counter-coupling element 18 (the first switching element 34 is shown with dash lines in FIG. 2). The cam 36 on the second switching element 35 displaces the following portion of the switching link 30 up to the driver 37 for the actuation switch 13 (not shown in FIGS. 2 and 3). Thus, at this orientation of the setting tool 10 relative to the vector G of the gravitational force, it can be actuated.

Even when the positioning device 20 is inclined relative to the orientation shown in FIGS. 1-3, maximum at about 25°-50°, an actuation is still possible. This is because the pin-shaped blocking numbers 55*a*, 55*b*, 55*c* remain in the regions of the channels 56 adjacent to the radially outer ends 58. If a pin-shaped blocking member 55*a*, 55*b*, 55*c* would only partially, i.e., with an end, extend in the overlapping channel 59, the safety device 50 still would remain in its release position, so that the blocking member can be pressed out of the recess 51 in a release position upon application of pressure to groove walls 52 of the recess 51.

Figure 5:
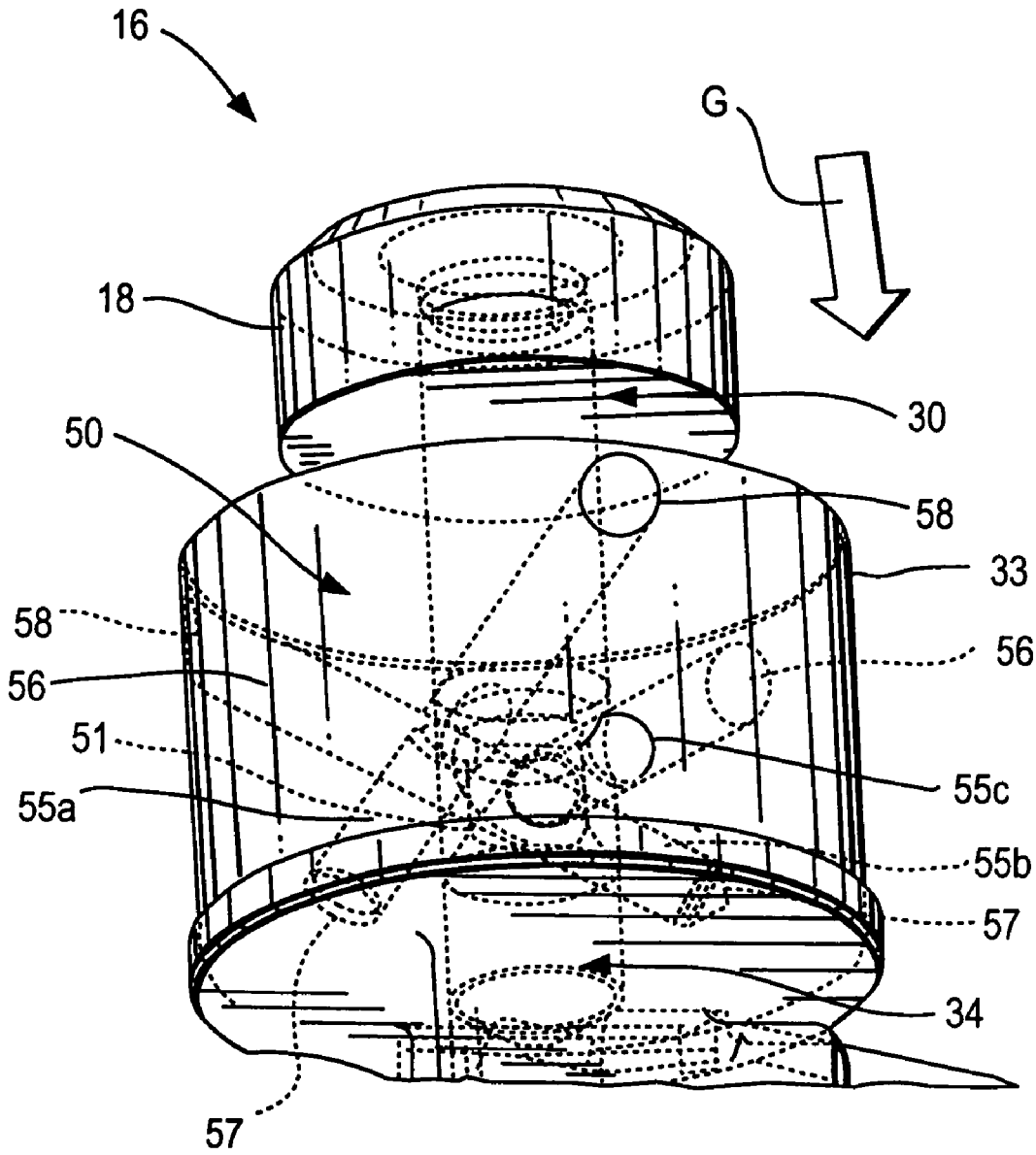
FIG. 5 a perspective view of a detail of the setting tool shown in FIG. 4, in a non-actuated position.

In FIGS. 4-5, the setting tool 10 (and the positioning device 20 not shown in FIGS. 4 and 5), together with the safety device 50, is oriented with its muzzle part 14 shown in FIG. 1 in the direction of the vector G of the gravitational force. As shown, all of the blocking members 55*a*, 55*b*, 55*c* are located in the regions of the respective channels 56 adjacent to the respective inner ends 57 of the respective channels 56. Therefore, due to the relationship of the length L3 of the respective blocking members 55*a*, 55*b*, 55*c* to the length L1 from the inner end 57 for the overlapping region 59, the blocking members 55*a*, 55*b*, 55*c* at least partially block the respective overlapping regions 59. Thus, the safety device 50 is in its blocking position at this orientation. If the setting tool 10, which is attached to the positioning device 20, is pressed with its muzzle part 14 against a constructional component at this orientation, a setting process cannot be initiated by movement of the actuation element 24 of the coupling element 28 (see FIG. 1). This is because the blocking members 55*a*, 55*b*, 55*c* due to their position in the recesses 51, in the blocking position, provide only for a very short displacement path of the first switching element 34 relative to the structural component 33. This very short path is much shorter than that necessary for a switching stroke.

At a horizontal orientation of the setting tool 10, i.e., perpendicular to the vector G of the gravitational fore (not shown in the drawings), at least one of the pin-shaped blocking members 55*a*, 55*b*, 55*c* is located in the blocking position and, thus, prevents a relative movement of the first switching member 34 with respect to the structural component 33

In one of the embodiments of channels 56, not shown in the drawings, the channels 56 can conically expand at their inner ends 57, whereby the central axis of the blocking members 55*a*, 55*b*, 55*c* would extend at an angle to axes of respective channels 56. Thereby, upon application of a dynamic pressure to the positioning device 20 with the setting tool 10 in the direction of the vector G of the gravitational force or transverse thereto, the blocking time, during which at least one pin-shaped blocking member 55*a*, 55*b*, 55*c* at least partially blocks the overlapping region 59, becomes longer because the blocking member 55*a*, 55*b*, 55*c* firstly, should align with respect to the central axis of the channel 56 before it can be withdrawn from the channel 56.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held setting tool comprising an actuation switch (13); connection means (16) for connecting the setting tool (10) to a positioning device (20) and having a counter-coupling element (18) for the positioning device (20); a structural component (33); and a mechanical switching link (30) including at least one first switching element (34) displaceable in the structural component (33) along a longitudinal axis (A) of the setting tool (10) for connecting an actuation element provided on the positioning device (20) with the actuation switch (13); and a safety device (50) for preventing actuation of the actuation switch (13) at an orientation other than a predetermined orientation of the setting tool (10) and including at least three separate channels (56), at least three blocking members (55*a*, 55*b*, 55*c*) displaceable in the at least three separate channels (56) respectively, and a recess (51) provided on the first switching element (34) for receiving the blocking members (55*a*, 55*b*, 55*c*) and which opens toward the structural component (33), wherein the at least three channels (56) are inclined with respect to a plane (E) extending perpendicular to the longitudinal axis (A), and wherein the at least three channels (56) intersect, in some regions, an axial projection of the first switching element (34) in the form of a secant and are open toward the first switching element (34) in respective overlapping regions (59).

2. A setting tool according to claim 1, wherein the at least three channels (56) are distributed about the longitudinal axis (A) rotationally symmetrically.

3. A setting tool according to claim 1, wherein the blocking members (55*a*, 55*b*, 55*c*) are pin-shaped.

4. A setting tool according to claim 1, wherein the first switching element (34) is rod-shaped and is displaceable in a guide channel formed in the structural component (33).

5. A setting tool according to claim 1, wherein the at least three channels (56) are inclined to the plane (E) each at an angle ($\alpha$) between 20° and 50°.

6. A setting tool according to claim 1, wherein the overlapping region (59) of each channel (56) with respect to the axial projection of the first switching element (34) on the longitudinal axis (A) has a depth (T) smaller than a diameter (D) of the channel (56).

7. A setting tool according to claim 1, wherein the recess (51) in the first switching element (34) is formed as an annular groove closed at opposite axial ends thereof.

8. A setting tool according to claim 1, wherein the recess (51) has walls (52) that limit the recess (51) in an axial direction and that are inclined to the longitudinal axis (A) so that an axial width of the recess (51) diminishes from a radially outer side to radially inner side.

* * * * *